United States Patent [19]

Varkonyi et al.

[11] Patent Number: 4,934,865

[45] Date of Patent: Jun. 19, 1990

[54] CATCHWATER DRAIN, EXCAVATING STRUCTURE AND METHOD OF CONSTRUCTION

[75] Inventors: Laszlo Varkonyi; Gyula Vaci, both of Miskolc; Csaba Asszonyi, Budapest, all of Hungary

[73] Assignee: Comporgan Rendszerhaz Kozos Vallalat, Hungary

[21] Appl. No.: 131,018

[22] Filed: Dec. 10, 1987

[30] Foreign Application Priority Data

Dec. 12, 1986 [HU] Hungary ..... HU-PAN05172/86

[51] Int. Cl.[5] ..... E02B 11/00

[52] U.S. Cl. ..... 405/50; 405/36; 405/43; 405/45; 405/52; 405/267

[58] Field of Search ..... 405/36, 50, 52, 272, 405/267, 282, 283, 45, 43, 48; 428/913, 186

[56] References Cited

U.S. PATENT DOCUMENTS

| | | | |
|---|---|---|---|
| 2,763,991 | 9/1956 | Kennon | 405/43 |
| 3,654,765 | 4/1972 | Healy et al. | 405/45 |
| 3,937,025 | 2/1976 | Alvarez-Calderon F. | 405/267 |
| 3,962,088 | 6/1976 | Kuhlenschmidt et al. | 405/43 X |
| 4,574,541 | 3/1986 | Raidt et al. | 405/45 X |
| 4,578,068 | 3/1986 | Kramer et al. | 428/913 X |

FOREIGN PATENT DOCUMENTS

| | | | |
|---|---|---|---|
| 1069549 | 11/1959 | Fed. Rep. of Germany . | |
| 1108160 | 6/1961 | Fed. Rep. of Germany . | |
| 137921A | 6/1986 | Japan | 405/282 |

*Primary Examiner*—Randolph A. Reese
*Assistant Examiner*—J. Russell McBee
*Attorney, Agent, or Firm*—Handal & Morofsky

[57] ABSTRACT

A process and structure is disclosed for the construction of catchwater drains, mainly deep catchwater drains, drain ribs, supporting ribs or similar structures, wherein a trench is excavated step by step in the soil, into which water collecting-aquiferous elements are laid, then suction bodies essentially filling out the trench are placed over the water collecting-aquiferous elements.

The process teaches that following the excavation of a trench-section to its full depth, inflatable hoses (5) of a temporary supporting structure (4) are consecutively laid into the trench (3), then the trench (3) is further opened and supported, and the hoses (5) of the temporary supporting structure (4) are removed one by one from the trench (3) and they are replaced by water collecting-aquiferous blocks (8) laid on the bottom (7) of the trench (3) so that they are situated at least partly in the impermeable soil layer, furthermore on top of these blocks (8) suction bodies (9) are placed consisting of granular material filled into filter bag.

10 Claims, 2 Drawing Sheets

CATCHWATER DRAIN, EXCAVATING STRUCTURE AND METHOD OF CONSTRUCTION

Figure 1:
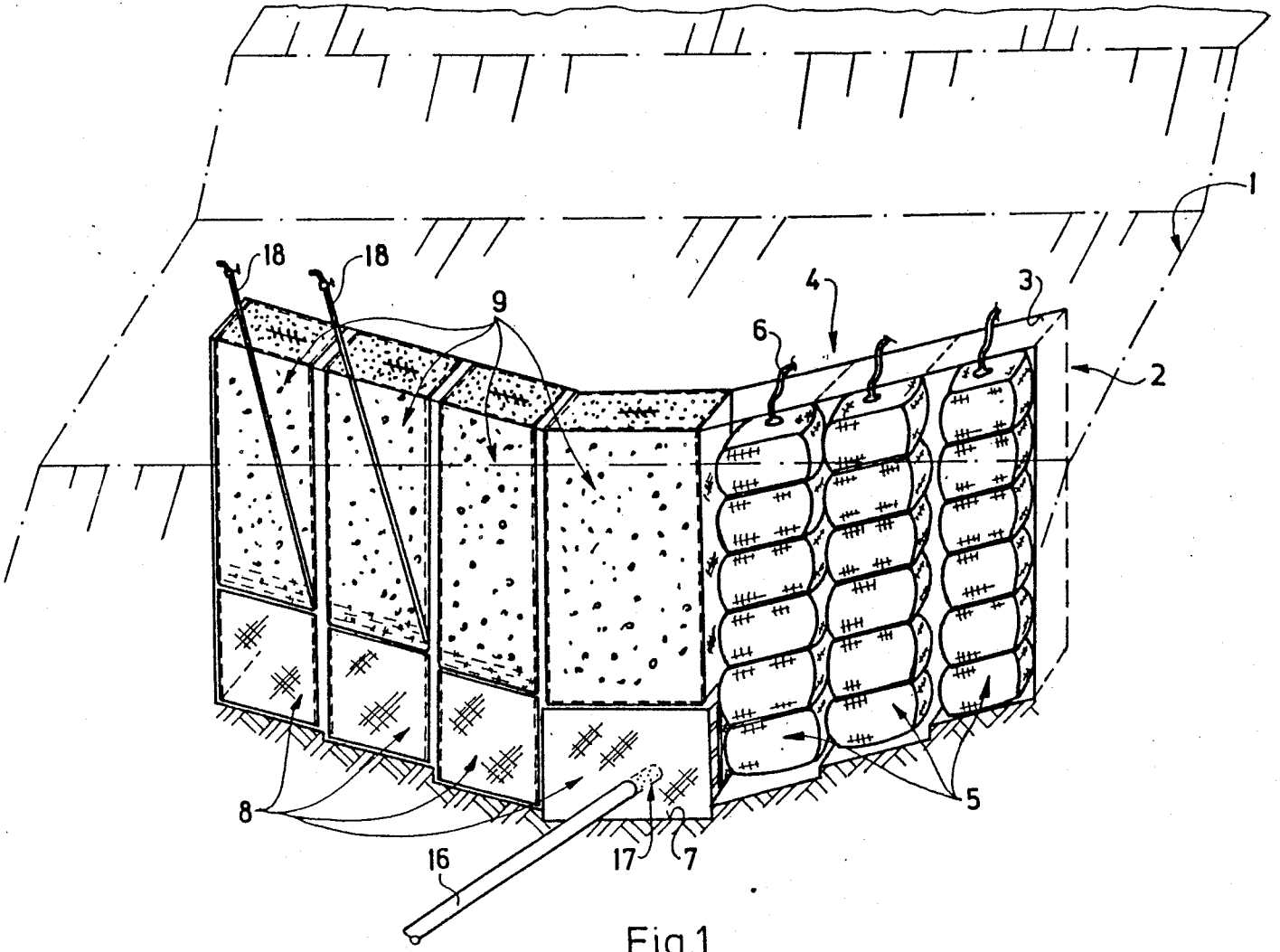

The invention relates to a process for the construction of catchwater drains, mainly deep catchwater drains, drain ribs or supporting ribs or similar structures. Furthermore the invention relates to a temporary supporting structure and a water collecting-aquiferous block for implementation of above process.

As known, the engineering structures collecting and draining the water seeping or flowing in the soil, are called "catchwater drains", or a "drain system". For example in the Hungarian patent specification No. 178 870 such process for the construction of a catchwater drain is described, wherein pipe sections made of synthetic material or asbestos are lowered by hand with the aid of ropes into a trench excavated along 3–4.5 m length, the trench is provided with a concrete bed and pipe connection blocks, and with temporarily covered perforations on the upper mantle-part. Thereafter dry concrete is shoveled around the pipe, then the strip covering the perforation is removed and crushing is shoveled over the pipe. This is followed by placing a reinforced concrete basket over the crushing, dimensioned according to the trench, the basket is lined with filter cloth and this is filled with granular material, e.g. gravel. Finally, the catchwater drain is sealed with a concrete plug or concrete layer.

Based upon experience, the above process is applicable only to stable soils, mainly clayey soils, and useful only for a limited depth. Especially in loose or sodden soils additional timbering have to be used at a depth of 5 m to prevent cave-ins.

Experience indicates that the use of such additional timbering is called for the work involves too high of an an in-creased accident hazard and a considerable amount of live labour. A further problem is that the drain pipe easily breaks due to the effect of the unavoidable soil movements, which means that such a catchwater drain is no longer capable of proper drainage, thus the whole structure needs replacement.

The present invention is aimed at elimination of above shortcomings, and at the realization of such process for the construction of durable catchwater drain, which requires involves low expenditures. Additionally, catchwater drains or supporting ribs can be constructed in a short time at an optimal depth and, furthermore the live labour can considerably be reduced.

In order to solve this problem, the starting point was the catchwater drain construction process described in the introductory part. This was further developed in the invention, such that during the excavation of the trench, temporary supporting units, such as inflatable hose-like elements, are consecutively laid into the trench at a suitable distance from each other. Then the temporary supporting units are removed one by one from the trench, and water collecting-aquiferous blocks with water gangs, at least along the traceline of the catchwater drain, are arranged in the trench so as to have them situated at least partly in the impermeable soil layer, as the temporary support units are removed.

According to a further distinctive feature of the invention, such construction is expedient, where the bottom of the trench slopes gradually in the direction of the drainage.

It is preferable to bore through the deepest lying water collecting-aquiferous block crosswise and to lay a drain pipe through the hole.

The inflatable hose-like temporary supporting structure is removed from the trench by lifting it out while its internal pressure is gradually reduced. In this manner, the risk of a cave-in can be further reduced.

The inventive process is favourably applicable for the construction of supporting structures, such as ribs, wherein the filter bag of the suction bodies is placed on the top of the water collecting-aquiferous block, the granular material, preferably crushing, is filled into the bag, followed by injection of strengthening binding material (e.g. cement mortar) in at least one suction body. In this manner the granular material of the suction body is formed to a continuous, solid supporting rib. Prior to injection, the suction bodies and/or the gaps between them can be provided with reinforcement.

For implementation of the process according to the invention, a temporary supporting structure is advantageous. Such a structure may consist consisting of flexible, inflatable, preferably multi-compartment, hose provided with at least one inlet-outlet valve for the pressure medium.

The water collecting-aquiferous block according to the invention is a formed rigid prismatic element, the width of which substantially fills out the trench, and it is provided with water gangs at least along the traceline of the catchwater drain, the ends of which are open for jointing them to the adjacent block. Furthermore the lateral faces of the block are at least partly perforated.

The water collecting-aquiferous block may be prepared from series of light, laminar elements firmly fixed to each other, and the perforated lateral face of the block may be formed with filter cloth covering the bundle of laminar elements. This way the laminar elements can have trapezoid or corrugated lateral face, whereby the water gangs can be brought about in a very simple way.

The invention is described in detail with the aid of the enclosed drawings illustrating some preferred embodiments of a catchwater drain built by the inventive process by way of example, in which:

FIG. 1: Perspective view showing the first example of an embodiment of a catchwater drain constructed with the process according to the invention.

Figures 2, 3, 4:
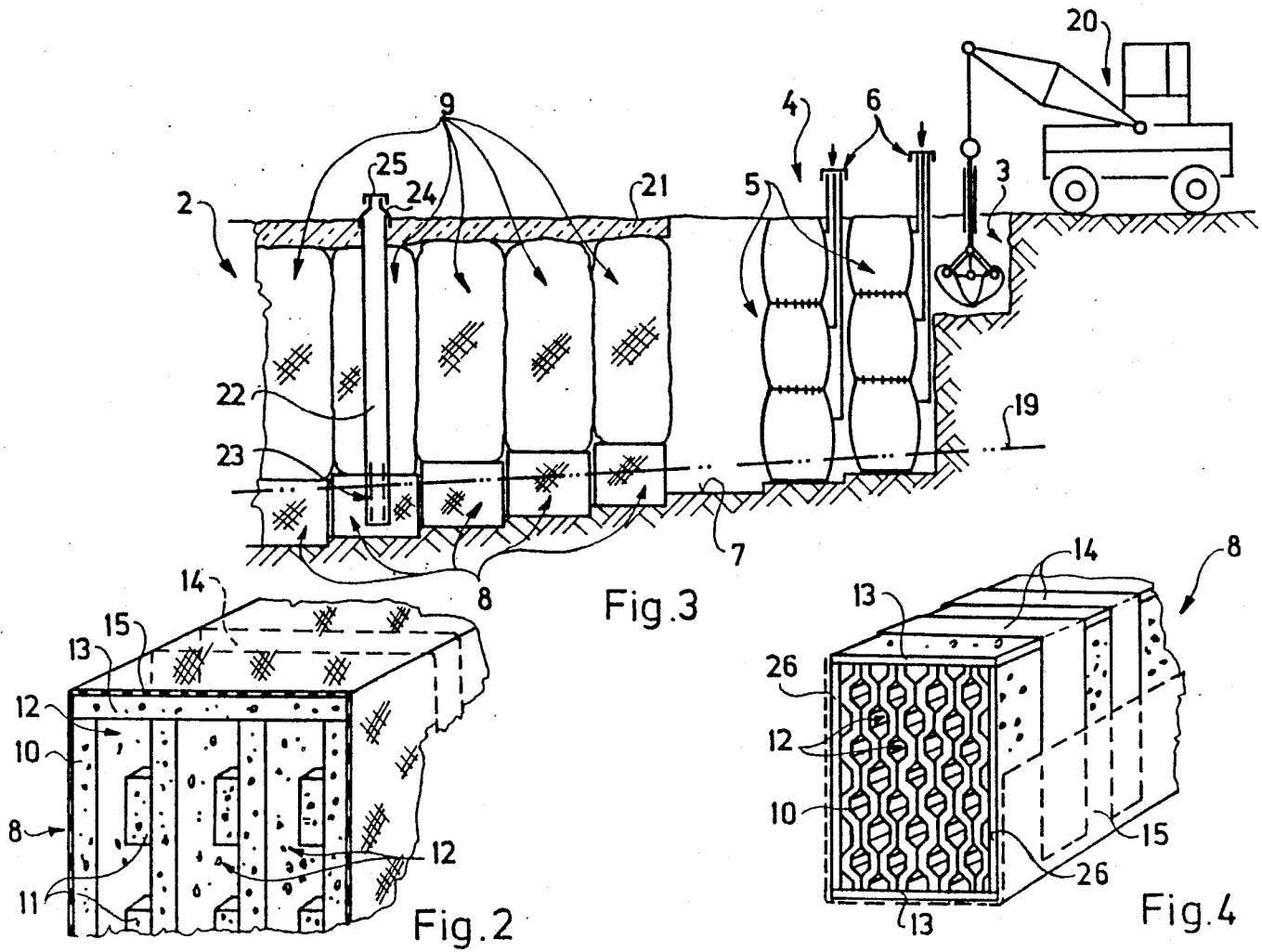

FIG. 2: Perspective view of one version of the water collecting-aquiferous block.

FIG. 3: Longitudinal section of another version of the process for construction of catchwater drain, where various phases of the construction are shown.

FIG. 4: Perspective view showing another example of a water collecting-aquiferous block according to the invention.

Similar details are marked with the same reference numbers in the drawings.

A catchwater drain of V-traceline shown in FIG. 1 was constructed in loose soil with a tendency to slide. The levelled groundsurface is marked with thin dashdot line and reference number 1. The catchwater drain according to the invention is marked with reference number 2. For its construction, first with dry cutting, a trench 3 was prepared, i.e. in the present case a 1.6 m long, 70 cm wide and 15 m deep pit was excavated. The various phases of the construction are shown in FIG. 1, the right side of which illustrates the phase when hoses 5 of a temporary supporting structure 4 are placed into the trench 3 prepared step by step.

This temporary supporting structure 4 consists of flexible, inflatable hoses 5, multi-partioned in the present case and each of them is provided with a valve 6 at the end near the groundsurface, for inlet and outlet of the pressure medium. Naturally the hoses 5 are inflated after laying them into the trench 3. Compressed air was used in this case as pressure medium, and the pressure value should be selected so as to ensure the stability of the trench 3 during construction. The hoses 5 may be made of any suitable synthetic material, or rubber sheet or foil, or other gastight material with adequate tensile strength.

FIG. 1 clearly shows a stepped bottom 7 of the trench 3 according to the invention.

After removal of the temporary supporting structure 4, a part of the completed catchwater drain is visible in the middle and on the left side of FIG. 1. This consists partly of water collecting-aquiferous blocks 8 laid on the bottom 7 of the trench 3 after gradually reducing the internal pressure and lifting the hoses 5, and partly of suction bodies 9 placed on top of the block 8.

According to the invention, the water collecting-aquiferous block 8 is a prismatic, retentive, prefabricated element, the width of which fills out the trench 3, and it is provided with water gangs at least in the direction of the proposed traceline of the catchwater drain. The water gangs are open at the both ends of the block 8 for jointing to the ducts of the adjacent block 8.

A preferred embodiment of the water collecting-aquiferous block 8, given by way of example, is shown in FIG. 2. According to the dimensions, the block 8 is rectangular. In the present case the block consists of light laminar elements 10 arranged vertically in longitudinal direction, and with a spacing between the adjacent elements that is ensured by distancing pieces 11. In this way longitudinal water gangs, 12 open at the ends of the block 8, are brought about between the laminar elements 10 of the block 8. Furthermore the laminar elements 10 of the block 8 are confined on the top and bottom by horizontal panels 13. The laminar elements 10 and the lower and upper panels 13 are fixed to each other by straps 14 (marked with dashed line in FIG. 2). The lateral faces of the block 8 are covered by a filter cloth 15. This can be made of a filter material known in the trade under the name "TERFIL" or of any other suitable material, e.g. a geotextile. The laminar elements 10 can be made preferably of retentive and sufficiently solid synthetic foam. The distancing pieces 11 and laminar elements 10 can be made of the same material.

The process for the construction of catchwater drain according to FIG. 1 is the following:

Proceeding from left to right, the trench 3 is opened with dry cutting. Upon reaching the required depth, the hose 5 of the temporary structure 4 is laid into the excavated pit, then the hose 5 is inflated with compressed air to the pressure required by the soil stability. Thereafter continuing the excavation of the trench 3 along the proposed traceline of the catchwater drain, a new pit is excavated and the next hose 5 is laid in it and inflated, the above activities are cyclically repeated. The hose 5 is lifted out of the trench 3 while the air pressure is reduced in it and the water collecting-aquiferous block 8 according to the invention is laid on the bottom 7 of the pit. The block 8 fills out nearly completely the cross section of the trench 3. Then a filter bag of the first suction body 9 is placed on the top of the block 8, and it is filled with conventional granular material, e.g. crushed stone. The upper part of the suction body 9 is situated in the vicinity of of the groundsurface, which can be sealed by conventional means, e.g. concrete plug (not shown).

This proceeds from the left to right until the catchwater drain is completed as described in the foregoing.

The bottom 7 of trench 3 was formed in the present case with gradation between 5 and 10 cm so that this gradation leads to the center. Here in the deepest part of the trench 3 is situated the water collecting-aquiferous block 8 to be tapped after construction of the catchwater drain. This may be accomplished by passing a cross directional drain pipe 16 through the block by drilling, pressing, or cutting, wherein the pipe is provided with perforations 17 where the pipe passes through the water collecting-aquiferous block. The drain pipe 16 may interconnect several catchwater drains from each other, and thus carry the water of the catchwater drain system into a conventional catchment system.

On the left side of FIG. 1 a further application is also illustrated, where the catchwater drain constructed as described above can be converted to a supporting rib. The process for this purpose differs only in that instead of just filling the suction bodies 9 with granular material, (e.g. crushing), a 50 mm diameter pipe 18 is placed into the textile bag of the suction body 9, followed the filling with crushing. Then a hardening binding material, in the present case cement mortar, is injected through the pipe 18 into the suction body 9, whereby it is converted to concrete supporting rib sufficiently resistant to the loads arising in the soil. In a given case, the strength of the supporting rib can be increased by placing reinforcement steel rods or mesh into the suction bodies, or in the gaps between them, and in this way a reinforced concrete supporting rib can be produced.

Such implementation is also feasible, where only a certain part of the suction bodies 9 are injected with cement mortar. In this case it is advisable to use diaphragm sheets between the adjacent suction bodies 9 and on the upper plane of the blocks 8 (not shown). This way a combined dewatering and supporting structure can be obtained.

Construction of a further drain rib built with the process according to the invention is shown in a sloping area, as illustrated in FIG. 3, where the permeable layer is marked with reference number 19 and an excavator with 20. In this embodiment the bottom 7 of the trench 3 is gradually sloping to the left. Each hose 5 of the temporary supporting structure 4 is provided with three compartments in the present case, and each compartment is connected through a separate, flexible pipe with the air inlet valve 6 situated in the vicinity of the groundsurface. Construction and mode of application of the temporary supporting structure 4, the water collecting-aquiferous blocks 8 and the suction bodies 9 are essentially identical with the embodiment shown in FIG. 1 and 2. The concrete "plug" sealing the catchwater drain 2 is marked with reference number 21.

A shaft 22 was additionally used in the embodiment shown in FIG. 3, serving for ventilation and observation of the drain system. The bottom part of the shaft 22 is provided with a perforated, 200–400 mm diameter, synthetic or steel pipe 23 corresponding to the depth of the catchwater drain, where the upper part is provided with a tapered reducing element 24 and a cap 25. The shaft 22 is laid into the water collecting-aquiferous block 8 during construction, by drilling a vertical hole of suitable diameter, into which the shaft 23 is lowered. After removing the cap 25 of the shaft 22, the condition of the drain rib can be observed, and in a given case ventilated.

A further embodiment of the water collecting-aquiferous block 8 is shown in detail in FIG. 4. This embodiment differs from the one shown in FIG. 2 in that here the laminar elements 10 are of trapezoid cross section, and the longitudinal water gangs 12 are realized by arranging the adjacent laminar elements 10 as shown in FIG. 4. Flat side panels 26 were used on the sides in the embodiment according to FIG. 4. The straps 14 interconnecting the panels can be made of the material of the filter cloth 15, or of any other suitable material. It is noted that for the sake of better understanding, the filter cloth 15 in FIG. 4 was illustrated only in part, but in the reality it completely covers the lateral faces of the block 8. The upper and lower panels 13, the laminar elements 10 as well as the lateral faces 26 are permeable in this embodiment.

Some advantages of the process according to the invention are that environmentally protective deep catchwater drain of optimal depth, supporting ribs, drying ribs and similar structures can be constructed, requiring minimal live labor and with a reduced accident risk in a relatively short time. It is unnecessary to go down into the pit, since the blocks 8 and the suction bodies 9 can be lowered from the top. A further advantage is that the fully excavated trench 3 can be instantly supported, section, by section with the pneumatic temporary supporting structure 4 according to the invention, and thus wall of the trench 3 is unsupported only for the time required for laying in the blocks 8 and the suction bodies 9. But because the sectioned open gap length was only max. 1.6 m during the experiments, caving in of the bank did not occur even in loose, wet soils to the depth of 6–15 m.

The blocks 8 according to the invention used in place of the relatively small diameter drain pipe, are rigid, light, continuously hollow, large cross sectional elements with considerably higher water-consuming capacity which are capable of out the soil with ventilation and evaporation. Another drying advantage is that a simple filter bag is used in the suction bodies 9 instead of the steel basket customary in the traditional technologies, thus no caving-in should occur.

The catchwater drain according to the invention—as proved by the experiments—can be successfully used for drying out fine-grained sand, e.g. sand-fluor, or clay varieties by evaporation even when the traditional, gravitational drainage is ineffective.

A still further advantage of the invention is its light structures, the building-in of which requires relatively little manual and mechanical work. With use of the pneumatic supporting structure 4, the construction technology is continuous. According to our experiments such catchwater drains discharge filtered water into the water-collecting system it requires minimal maintenance, and sedimentation of the filter cloth does not occur.

Besides the cement mortar, in a given case water glass or any other suitable material is also applicable as hardening liquid. The laminar elements 10 of the blocks 8 are suitably of porous texture, thus cross-directional water flow is also possible. In given cases, besides the water gangs 12 along the traceline, cross-directional, horizontal or even vertical water gangs can also be formed in the blocks 8.

We claim:

1. A process for construction of catchwater drains, drain ribs, supporting ribs or similar structures comprising the steps of:

(a) making a first trench-section having a bottom and side faces to its full depth in the soil along a proposed traceline of said catchwater drain;

(b) placing a first inflatable hose of a temporary supporting structure into said first trench-section;

(c) inflating said first hose to an internal pressure sufficient to ensure stability of the faces of said first trench-section;

(d) making a second trench-section to its full depth in the soil adjacent to said first trench-section along said traceline;

(e) placing a second inflatable hose of said temporary supporting structure into said second trench-section;

(f) inflating said second hose to a desired internal pressure, thereby ensuring temporary stability of faces of said second trench-section;

(g) deflating said first hose in said first trench-section;

(h) removing the first hose and placing at the bottom portion of the volume occupied by said deflated first hose a first water collecting-aquiferous block laid on the bottom of said first trench-section, said block being placed at least partly in a relatively impermeable soil layer thereby filling out a substantial portion of the lower area of said first trench-section;

(i) placing at least one first suction body on top of said first water collecting aquiferous block, said suction body consisting of granular material filled into a filter bag, said filter bag filled to an upper part of said first suction body in the vicinity of the ground-surface; and (j) making another trench-section using the steps (a) to (i) along the traceline until the catchwater drain is completed.

2. A process as claimed in claim 1 further comprising making said bottom of the trench-section gradually deeper in the direction of a drainage.

3. A process as claimed in claim 1 further comprising connecting at least one of said water collecting-aquiferous blocks, situated in the deepest position in said trench, with a drain pipe.

4. A process as claimed in claim 1 further comprising lifting said inflatable hose out of its trench-section while the internal pressure in said hose is gradually reduced.

5. A process as claimed in claim 1 further comprising, after placement of said at least one suction body, filling binding material, mainly cement mortar for hardening said granular material into at least one of said suction bodies.

6. A process as claimed in claim 5 further comprising, prior to said filling step, placing reinforcement, mainly rods or meshes, into said suction bodies.

7. A process as claimed in claim 5 further comprising, prior to said filling step, placing reinforcement into gaps between said suction bodies.

8. A process as claimed in claim 1, further comprising using three or more inflatable hoses in said temporary supporting structure.

9. A process as claimed in claim 1, wherein said making of another trench section is performed after the completion of the making of the first trench-section by repeating steps (a) to (i) in sequence.

10. A process as claimed in claim 1, further comprising making all trench-sections necessary to cover the traceline of said catchwater drain and stabilizing said trench-sections by said temporary support structure before the deflation and replacement of said hoses with water collecting-aquiferous blocks and suction bodies begins.

* * * * *